US007506775B2

(12) United States Patent
Hartzell et al.

(10) Patent No.: US 7,506,775 B2
(45) Date of Patent: Mar. 24, 2009

(54) SHELTER MAST SUPPORT SYSTEM

(75) Inventors: Craig W. Hartzell, Morgantown, WV (US); Kevin G. Koch, Fairmont, WV (US); Aaron M. King, Kingwood, WV (US)

(73) Assignee: Azimuth, Inc., Morgantown, WV (US)

( * ) Notice: Subject to any disclaimer, the term of this patent is extended or adjusted under 35 U.S.C. 154(b) by 0 days.

(21) Appl. No.: 11/164,032

(22) Filed: Nov. 8, 2005

(65) Prior Publication Data

US 2007/0102595 A1 May 10, 2007

(51) Int. Cl.
*B65D 88/00* (2006.01)

(52) U.S. Cl. ..... 220/1.5; 248/125.1; 248/125.7; 248/122.1; 248/158; 248/405; 248/213.2; 248/519; 248/121; 248/124.1; 248/125.8; 248/161; 248/159; 248/523; 24/287; 220/694; 220/23.4; 211/107

(58) Field of Classification Search ..... 248/125.1, 248/125.7, 122.1, 158, 405, 213.2, 519, 121, 248/124.1, 125.8, 161, 159, 523; 211/107; 24/287; 220/1.5, 694, 23.4
See application file for complete search history.

(56) References Cited

U.S. PATENT DOCUMENTS 1,291,823 A * 1/1919 Fuller ..... 52/40
2,661,918 A * 12/1953 Riggs ..... 248/536
2,947,556 A * 8/1960 Wenger ..... 403/290
3,134,978 A * 5/1964 Arvay, Jr. ..... 343/709
3,150,853 A * 9/1964 Lisbin ..... 248/188.4
3,560,987 A * 2/1971 Lockwood ..... 343/880
4,193,351 A * 3/1980 Belokin, Jr. ..... 108/59
4,662,132 A * 5/1987 Tennant ..... 52/148
4,688,684 A * 8/1987 Young et al. ..... 211/59.4
4,993,125 A * 2/1991 Capron et al. ..... 24/287
5,155,960 A * 10/1992 Shaanan ..... 52/584.1
5,193,325 A * 3/1993 Allison ..... 52/745.02
5,317,857 A * 6/1994 Allison ..... 52/79.1
5,498,097 A * 3/1996 Shapess ..... 403/322.1
6,768,474 B2 * 7/2004 Hunt ..... 343/892
6,793,367 B1 * 9/2004 Chan ..... 362/190
7,059,488 B2 * 6/2006 Myers ..... 220/1.5

* cited by examiner

*Primary Examiner*—J. Allen Shriver, II
*Assistant Examiner*—Nkeisha J Dumas
(74) *Attorney, Agent, or Firm*—Monika J. Hussell; Dinsmore & Shohl, LLP

(57) ABSTRACT

A mast support system for use with a container (e.g., a Connex container) to hold a light fixture, security camera and other accessories that may be desirable to mount above or from the roof of the container, generally comprising a support structure for purposes of supporting the accessories, and means to affix the support structure to the container. Embodiments of the mast support system disclosed include one or more posts removably attached to a base, which is engaged with the corner of a container. Attached to the posts are accessory support systems, extending therefrom for positioning and angling the accessories.

7 Claims, 12 Drawing Sheets

A
25
1
22
2
26
40
23
21
23
21A
2

SHELTER MAST SUPPORT SYSTEM

The present invention comprises a mast support system for use with a container (e.g., a Connex container) to hold a light fixture, security camera and other accessories that may be desirable to mount above or from the roof of the container. It is contemplated that the container will be used as a shelter or office, but the system disclosed may be used in other applications as well.

The mast support system of the present invention generally comprises a support structure for purposes of supporting the accessories, and means to affix the support structure to the container.

Certain embodiments of the mast support system disclosed within are economical, easy to manufacture, and advantageously utilized in the field. There are other aspects of the present invention and the various disclosed embodiments that will become apparent as the specification proceeds.

The preferred embodiments of the present invention and portions of the container with which it is used are shown in the accompanying drawings, wherein.

Figure 7:
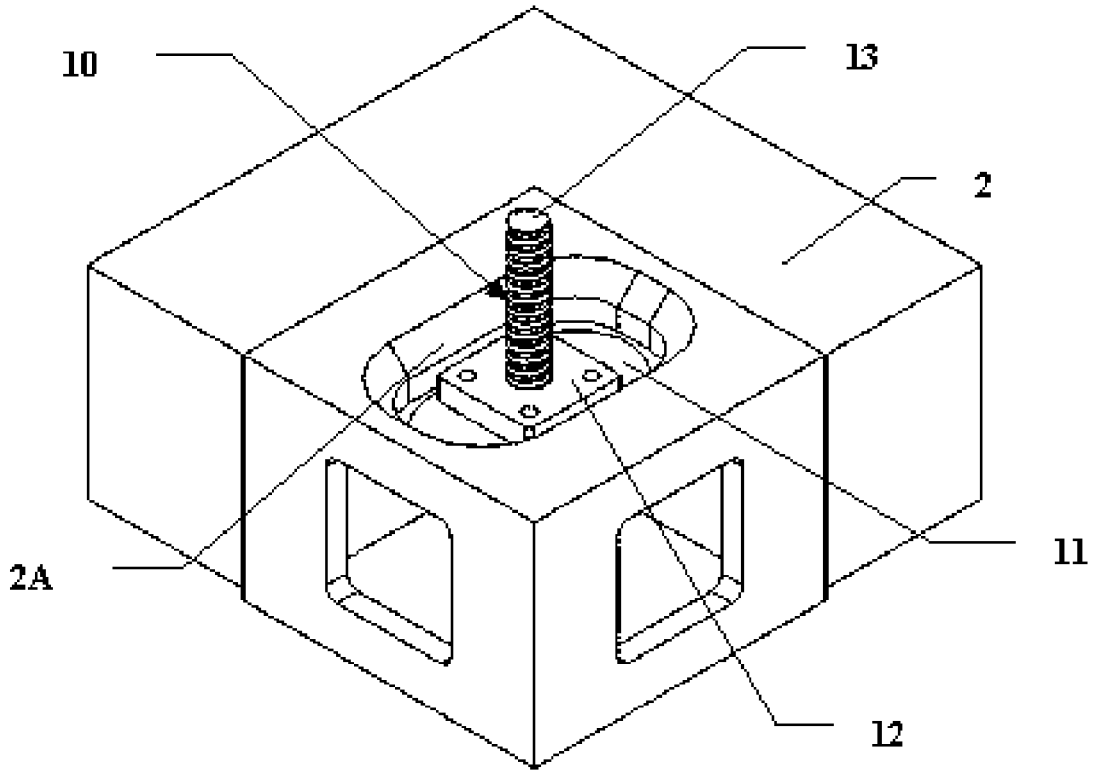
Figure 8:
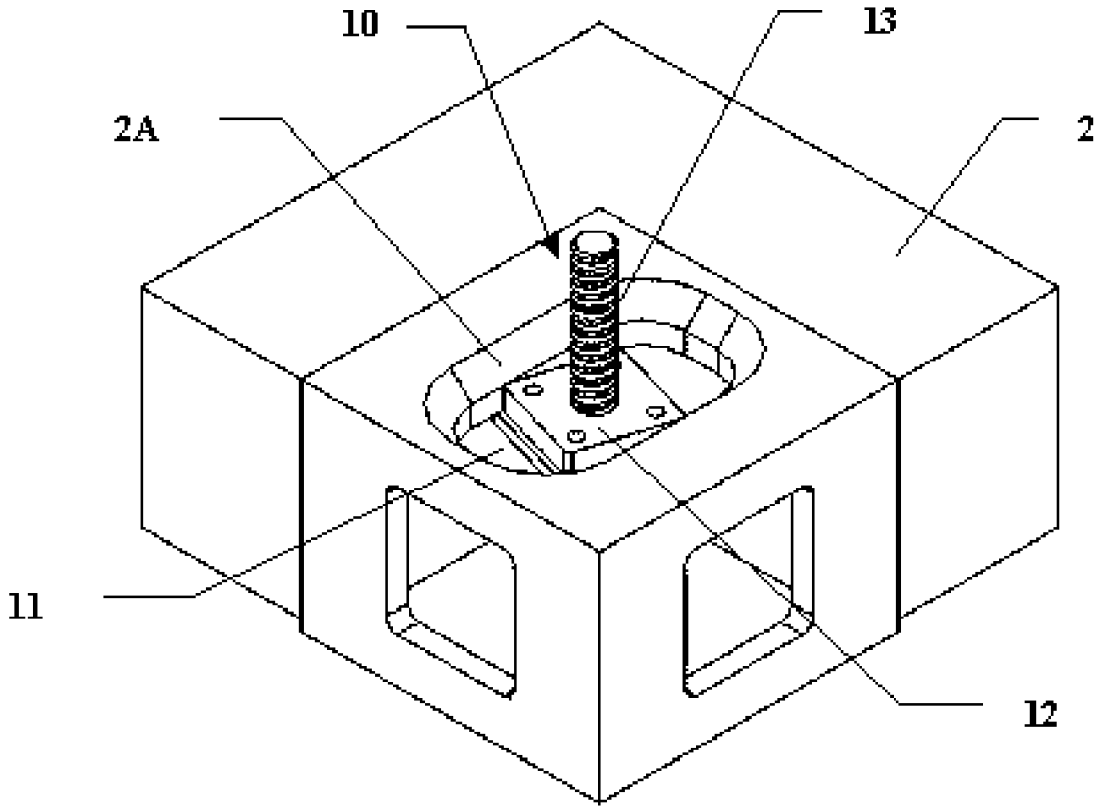
Figure 9:
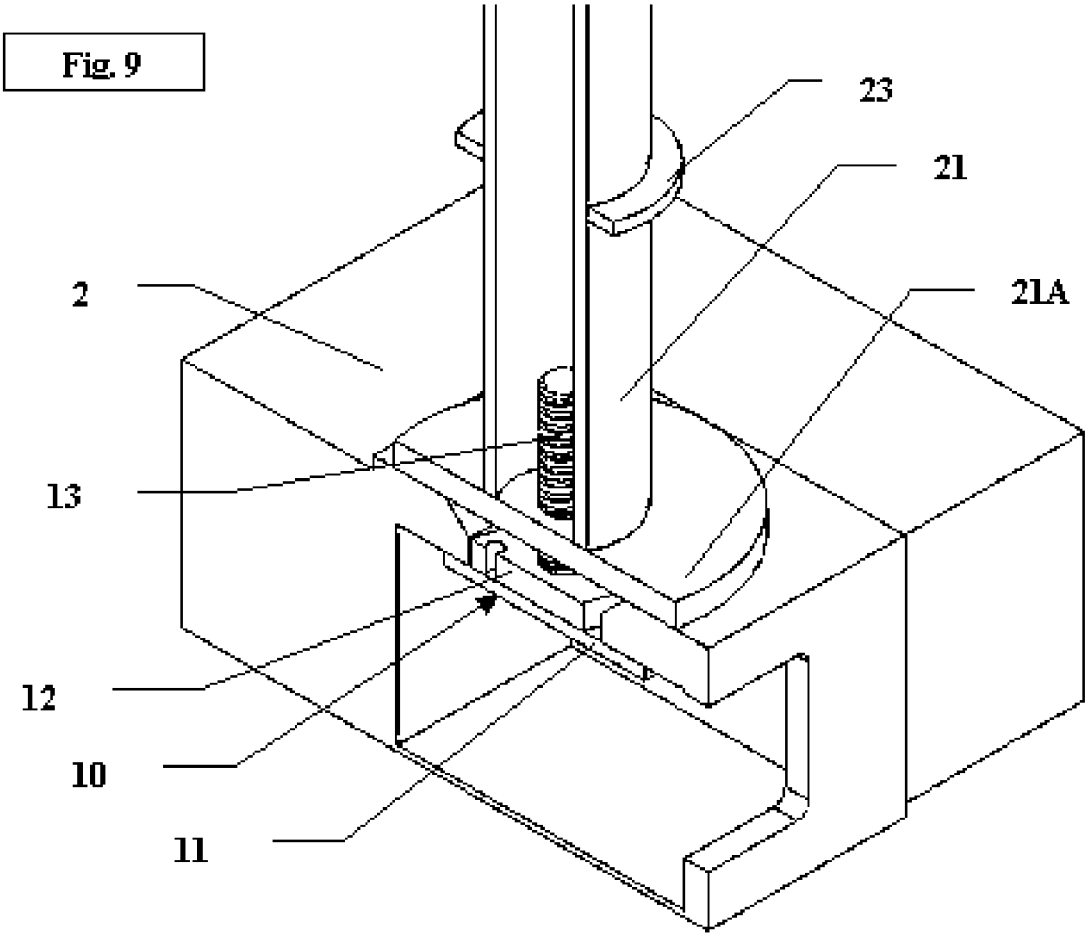
Figure 10:
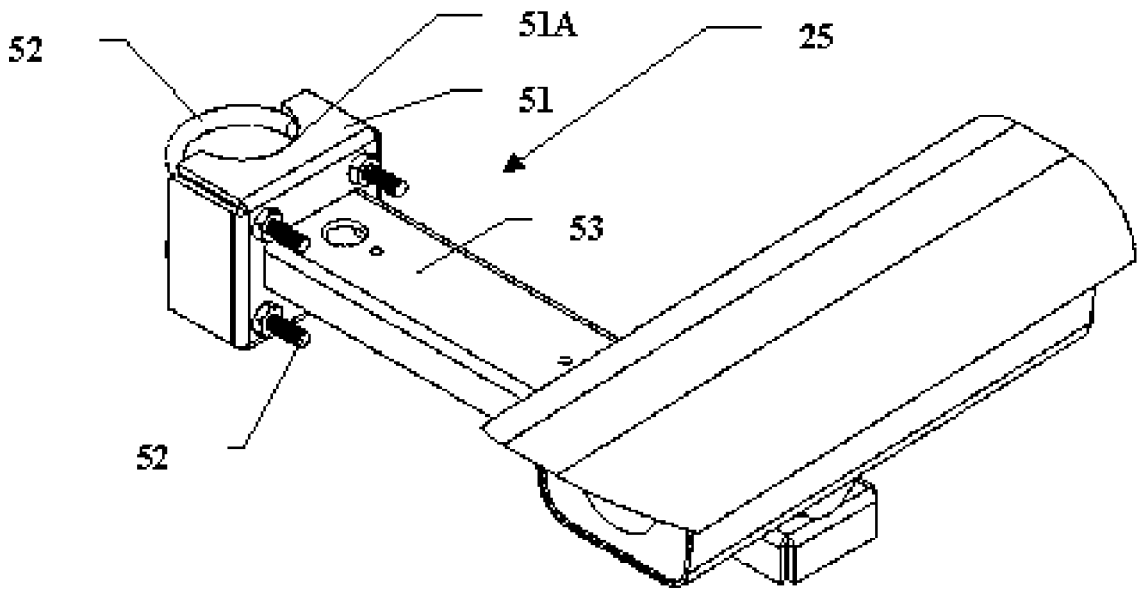
Figure 11:
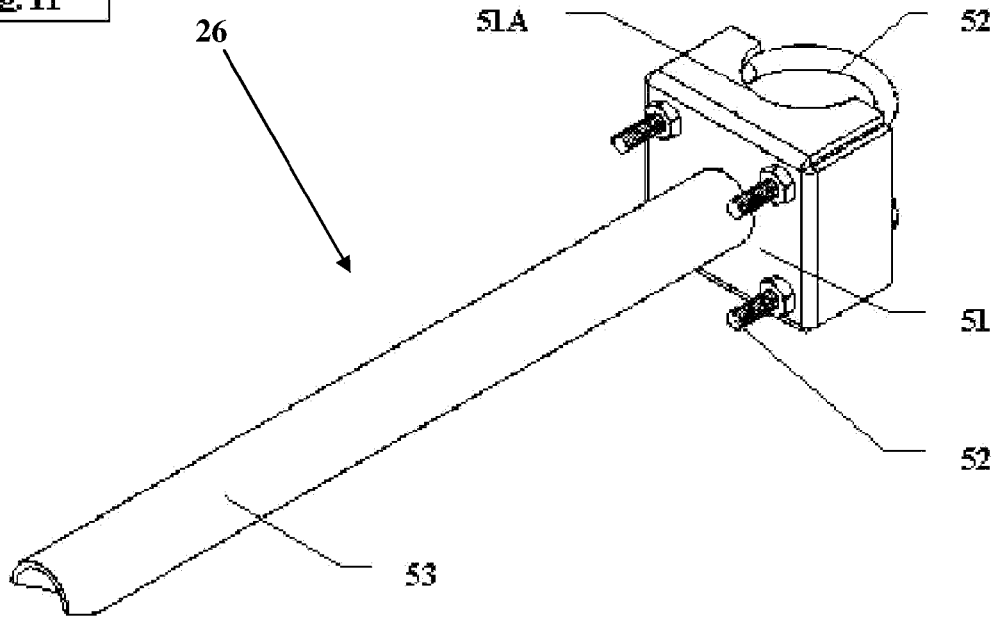
Figure 12:
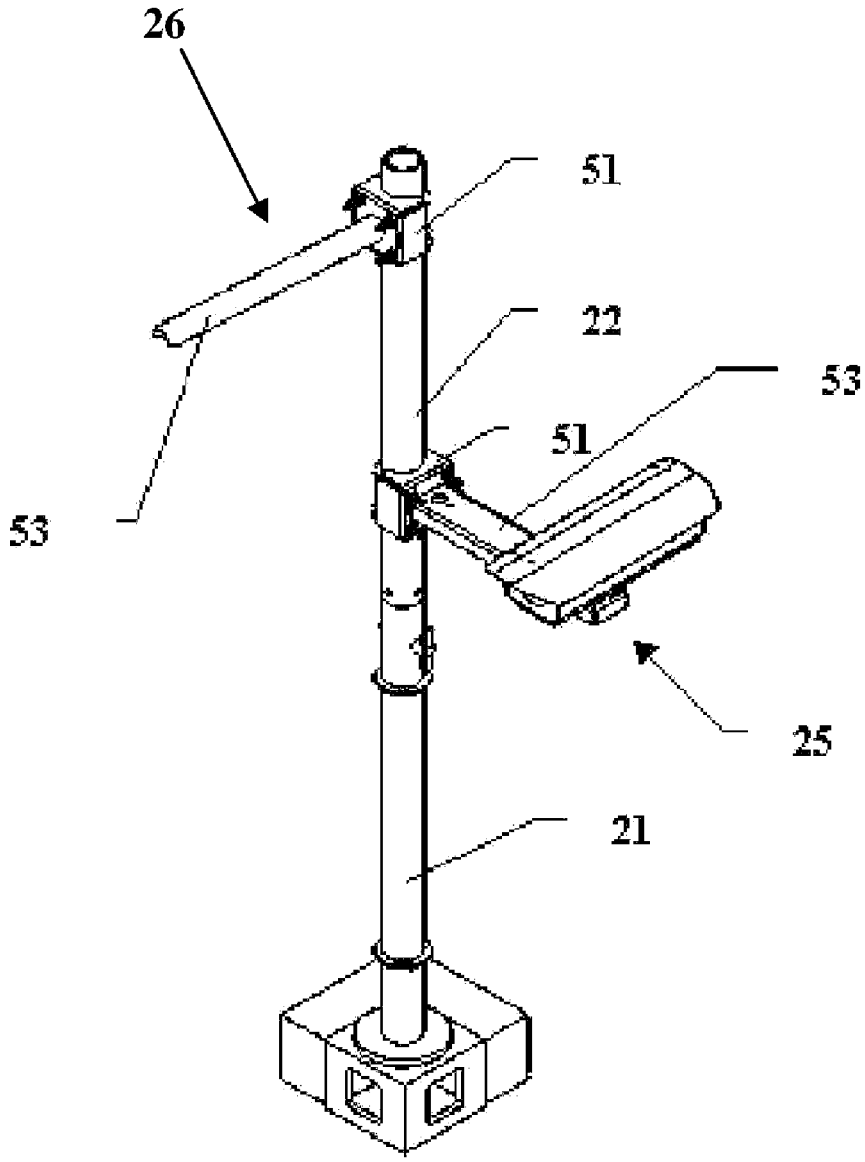

FIG. 7 is a perspective view of the method of inserting the base 10 of an embodiment of the present invention into the elliptical aperture 2A of a corner 2 of a container 1;

FIG. 8 is a perspective view of the method of rotating the base 10 of an embodiment of the present invention to secure the same within the corner 2 of a container;

FIG. 9 is a perspective, cut-away view of an embodiment of the base 10 and the lower post 21, when assembled;

FIG. 10 is a perspective view of an embodiment of the accessory support structure of the present invention;

FIG. 11 is a perspective view of another embodiment of the accessory support structure of the present invention; and FIG. 12 is a perspective view of an embodiment of the mast support system of the present invention.

In the following detailed description of the preferred embodiments, reference is made to these drawings, which form a part of this specification. The drawings show, by way of illustration, specific embodiments. It is to be understood that other embodiments may be utilized and structural changes may be made without departing from the scope of the present invention.

Figure 2:
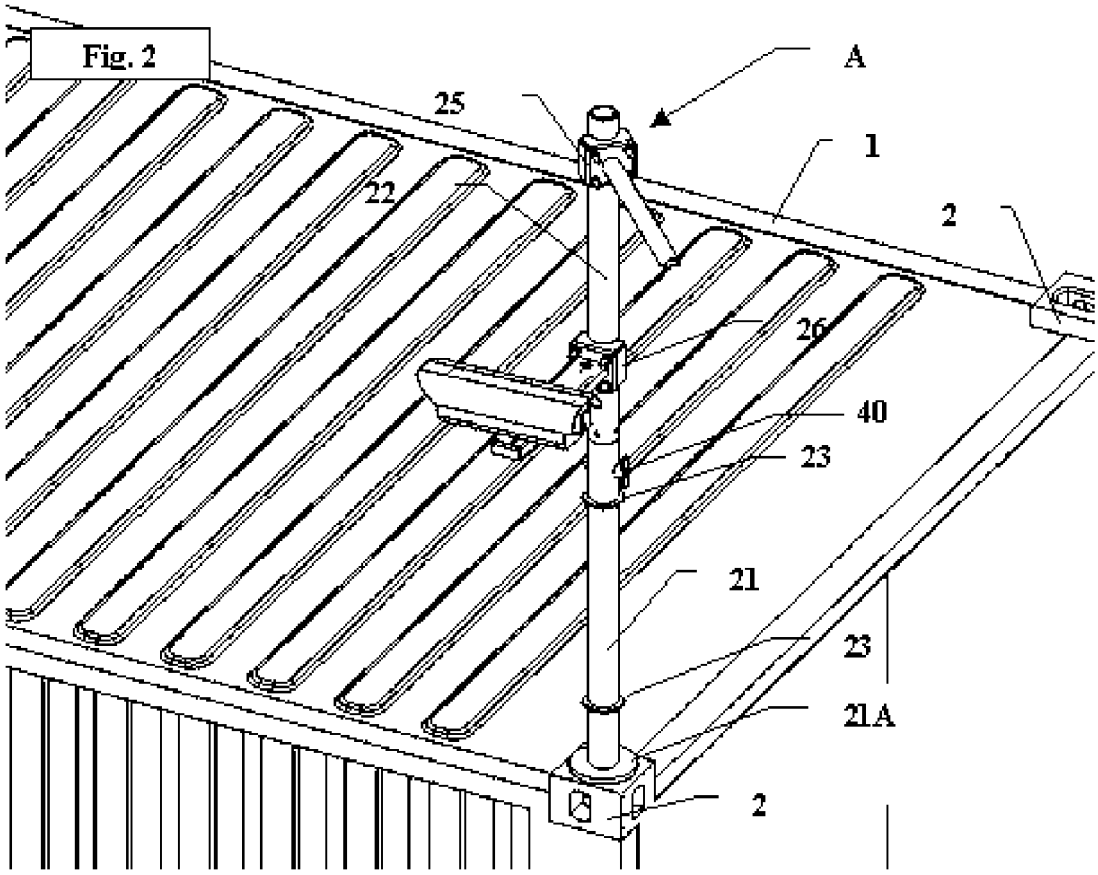
FIG. 2 is a perspective view of one embodiment of a mast support system of the present invention, mounted on the corner of the container shown in FIG. 1.

The support structure A of the present invention comprises one or more posts designed and configured to support the accessories mounted thereon, means to removably affix the posts to the container, and one or more accessory support substructures which may be affixed or removably attached to the posts. Depicted in FIG. 2 is an embodiment of the present invention, using two posts, 21 and 22, and two accessory support substructures, 25 and 26. The use of multiple posts 21 and 22 allows the support structure to be configured in different heights, and provides a more compact system when disassembled for purposes of shipping and storage; however, single posts may be used to practice the invention as disclosed herein, and may be provided in varying heights. The height of the support structure A determines the number of accessories that may be supported by said structure and the positioning of said accessories (including the angles available to said accessories); for shorter masts, the support structure A offers less space for mounting of accessories, and fewer possible angles for the accessories to be positioned in.

Figure 3:
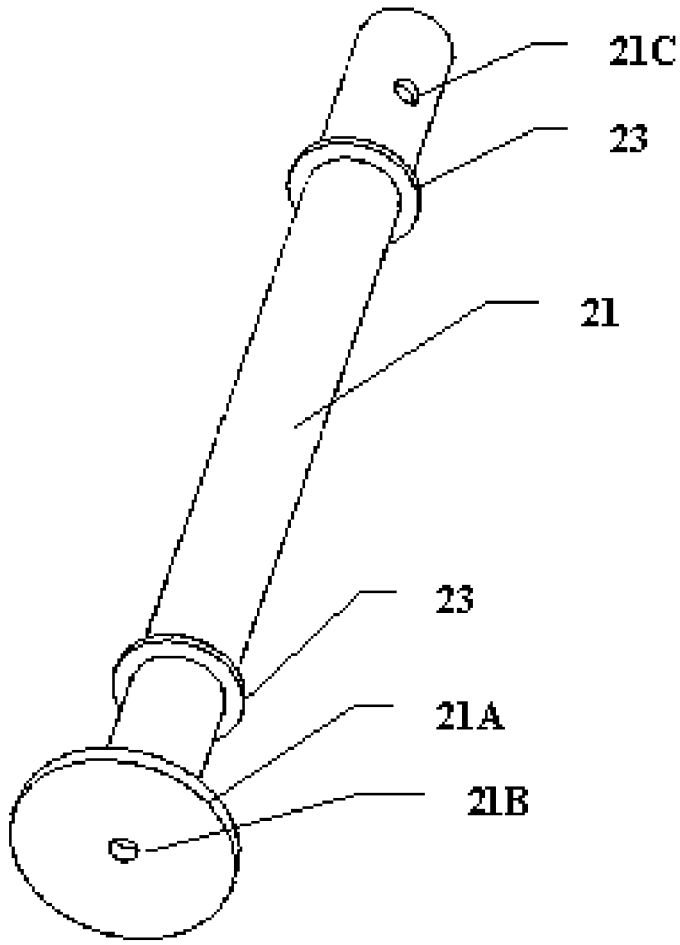
FIG. 3 is a perspective view of the lower post of the embodiment of the present invention shown in FIG. 2.

Referring now to FIG. 3, the lower post 21 of the support structure A is preferably a hollow tube. A short, solid cylinder 21A may be affixed to the bottom end of the tube 21 to provide additional support for the support structure A, and a means to fasten the same to the affixation means as hereinafter described. In association with the embodiment of the affixation means as hereinafter described, the solid cylinder 21A is larger than the elliptical aperture 2A of the corner 2, and has a threaded hole 21B adapted to receive a threaded rod of the screw 13 of said affixation means.

Figure 4:
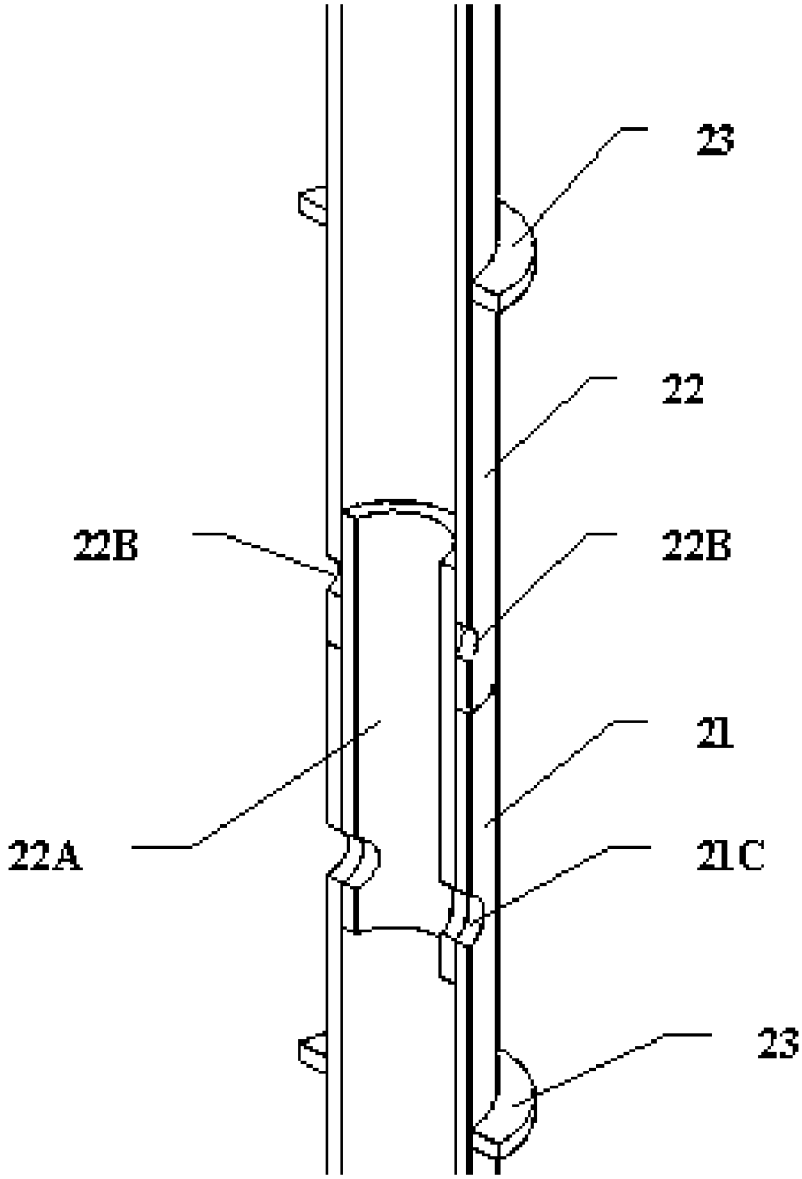
FIG. 4 is a cut-away view of the upper and lower posts of the embodiment of the present invention shown in FIG. 2.

With reference to FIGS. 2, 3 and 4, in multiple-post systems, the lower post 21 further has means of receiving the upper post 22. Preferably, the lower post 21 is hollow at the top end thereof to receive an inner tube 22A of the upper post 22, as hereinafter described, and further comprises holes 21C to receive a fastener 27, as hereinafter described. Optionally, the lower post 21 may further comprise one or more holes or apertures at the bottom thereof to facilitate the removal of water and debris from the post system.

Figure 5:
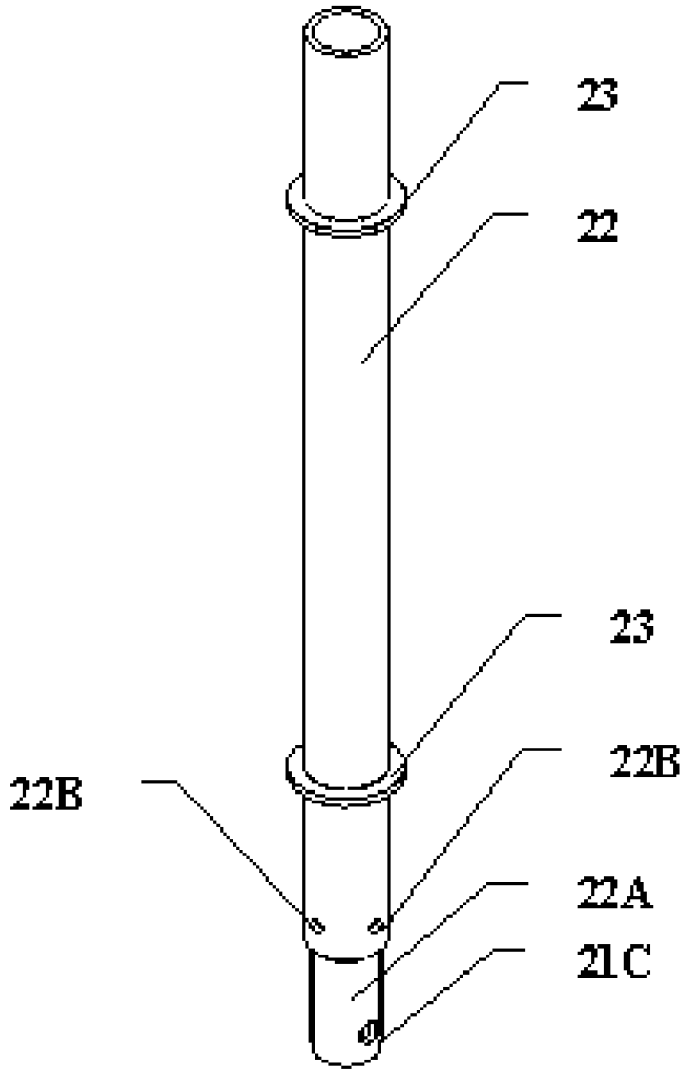
FIG. 5 is a perspective view of the upper post of the embodiment of the present invention shown in FIGS. 2 and 4.

As depicted in FIGS. 2, 4 and 5, the upper post 22 of the support structure A is preferably a hollow tube having the same outer and inner circumferences as the tube of the lower post 21. A second, preferably hollow cylinder 22A may be radially affixed near, and extending beyond, the lower end of the tube 22 to provide additional support for the support structure A and a means to fasten the upper post 22 to the lower post 21. The inventor prefers to weld the hollow cylinder 22A to the upper post 22, using standard welding techniques and the holes 22B of the post 22. The cylinder 22A preferably has an outer circumference slightly smaller than the inner circumference of the upper post 22 and the lower post 21, so that the same may be inserted into both posts, and will provide support to the support structure A. In association with the embodiment of the lower post 21 as described above, the cylinder 22A has holes 21C adapted to receive the fastener when the lower post has received said cylinder, and the holes 21C of the cylinder 22A are aligned with the corresponding holes 21C of the lower post 21. Alternatively, the cylinder 22A may be affixed to the lower tube, and may be removably affixed to the upper tube 30 using the fastener system as described hereinabove.

A fastener 40 is used to removably affix the inner tube 22A of the upper post 22 to the lower post 21, by means of the holes 21C. Your inventors prefer to use a stainless steel, quick release pin as the fastener 40, inserting the same through the aligned holes 21C of the lower post 21 and the inner tube 22A; however, other means of removably affixing the posts 21 and 22 sufficient to securely support the accessories may be used (for example, but without limitation, a bolt and nut system).

The lower post 21 and the upper post 22 may have one or more ledges 23 interspersed radially along the exterior surface thereof, which may be used and positioned to support the accessory support substructures, and the accessories mounted thereon, at a desirable height above the container 1.

Figure 1:
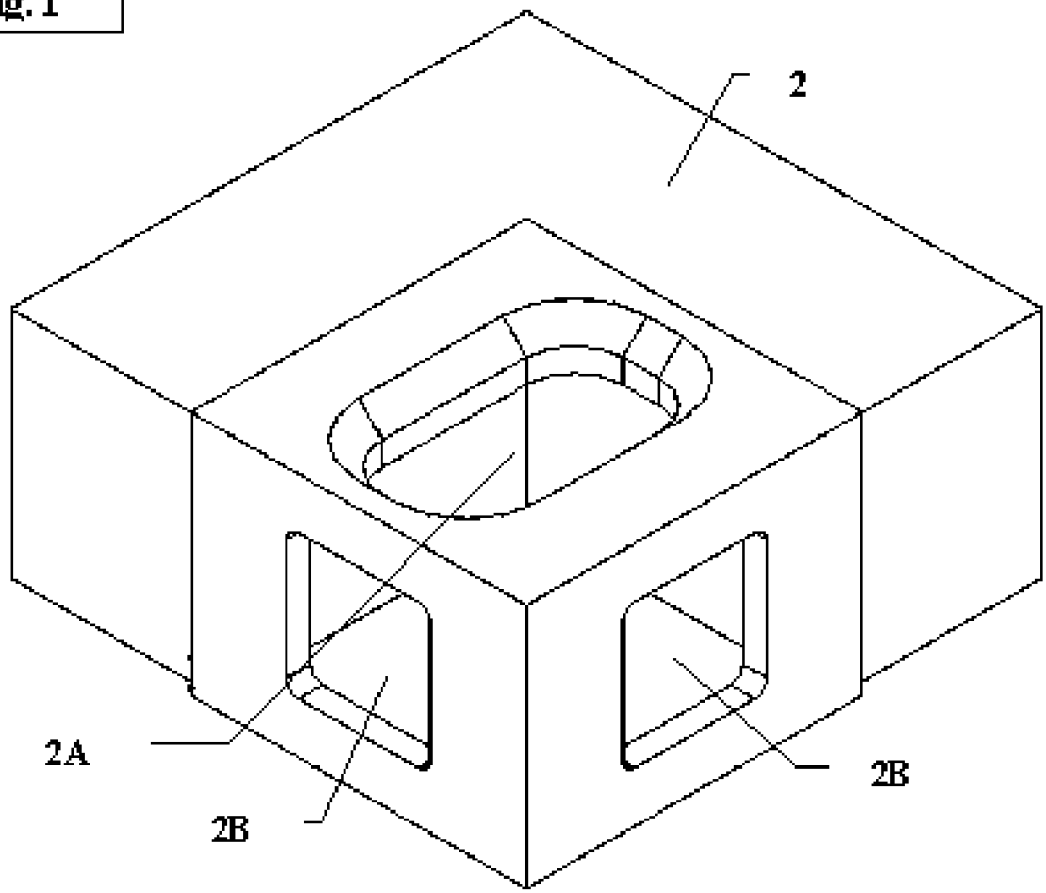
FIG. 1 is a perspective view of a corner of the container with which the present invention may be engaged.

Referring now to FIGS. 6-9, an embodiment of the means to affix the posts 21 and 22 to the container 1 comprises a base 10 designed and configured to engage with the corner 2 of a standard ISO container. As shown in FIGS. 1 and 2, standard ISO containers comprise multiple hollow corners 2, each having an elliptical aperture 2A on the top surface thereof and other apertures 2B on the exposed side surfaces thereof, intended to receive the hook of a crane or other machinery and allow the container 1 to be moved in shipping and storage.

Figure 6:
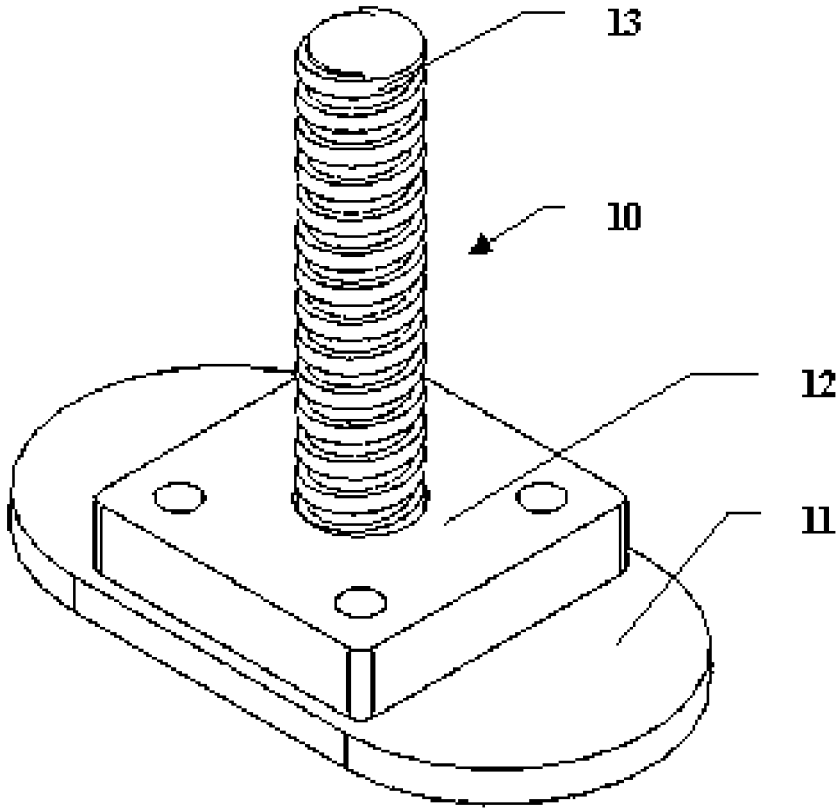
FIG. 6 is a perspective view of an embodiment of the means to affix the support structure to the container.

As shown in FIG. 6, the base 10 of the present invention may comprise, in an embodiment thereof: a foot 11, which corresponds in shape to the elliptical aperture 2A of the container corner 2 so that the foot 11 may pass wholly through said aperture 2A when positioned in a first direction, but not in a second direction lateral to the first; a washer 12 which, when in place as hereinafter described, will inhibit the base 10 from rotating in the container corner 2; and a screw 13, such as an acme screw. In this embodiment of the affixation means, each of the foot 11 and the washer 12 have a bore hole through or near the center thereof to receive the threaded rod of the screw 13. Furthermore, the foot 11 may have a recess on the under-surface thereof to substantially receive the head of said screw 13, so that the head is substantially flush with the under-surface of said foot 11. The washer 12 is preferably affixed to the foot 11 by welding or otherwise, to inhibit rotation of the base 10 when the same is in position in the container corner 2, as hereinafter described.

Referring to FIGS. 10-12, a further embodiment of the present invention includes accessory support substructures 25 and 26, which facilitate removable attachment of accessories (such as light fixtures and security cameras) to the tubes 21 and 22, and in an embodiment thereof comprise a box 51, having at least three sides, configured to partially receive a post 21 or 22 of the present invention on a side 51A thereof. The box 51 in this embodiment is removably affixed to the post 21 or 22 by means of two U-bolts 52, which are configured to wrap around the post 21 or 22, extend through apertures on the front face of the box 51, and be secured thereto by means of corresponding nuts; when positioned on the post 21 or 22, the box 51 may be further supported by one of the ledges 23, where the box 51 is positioned immediately above the ledges 23. From the front face of the box 51 is affixed and extends a tube or other support structure 53 to which the applicable accessory is removably attached. The accessories intended to be used with the present invention typically have affixation means that can be engaged with the support structure 53. As an example, surveillance cameras typically have a threaded base to receive a threaded screw; in this example, the support structure 53 includes a screw, allowing the surveillance camera threaded base to receive said screw, thereby mounting the camera on the support structure 53.

Preferably, the base 10 as described in the embodiment above, and its components, are constructed of stainless steel; however, any other material capable of supporting the weight of the mast and the accessories intended to be supported thereby, as well as to withstand adverse weather conditions, would be suitable. The foot 11 and washer 12 of the base 10 are preferably affixed together, by welding and positioning or otherwise, or may be partially or wholly formed as a single unit by molding or machining. The post system, including the posts 21 and 22 and each of their components, is preferably manufactured from aluminum, or any other material or combination of materials suitable for purposes of securely supporting the accessories intended to be mounted on the same, and to withstand adverse weather conditions.

Referring to FIGS. 7-9, to assemble the mast of the embodiments of the present invention as disclosed herein, the base 10 is dropped through the elliptical aperture 2A of the corner 2 of the container 1; it is then rotated about 90° and pulled up until the top surface of the foot 11 is in flush contact with the underside of the top surface of the corner 2, and the washer 12 is within the elliptical aperture 2A (as shown in FIGS. 8 and 9). The lower post 21 is then screwed to the base 10 by means of the screw 13 being received by the cylinder 21A of the lower post 21. When the cylinder 21A of the lower post 21 receives the threaded rod of the screw 13, the top end of the corner 2 gets clamped between the base 10 and the cylinder 21A. The upper post may be secured to the lower post by aligning the holes 21C of the inner tube 22A with the holes 21C of the lower post 21, and inserting fastening means 40 therethrough. One or more accessory support substructures 25 and 26 is affixed to the post 21 or 22, so that the same rests on a ledge 23 of said post, by placing the tube receiving side 51A along the post 21 or 22, inserting the U-bolts 52 around the post and through the apertures of the box 51, and securing the same with corresponding nuts.

What is claimed is:

1. A standard shipping container having a roof and a mast support system removably affixed to said roof, comprising:

said container roof having a hollow corner, said corner having a top surface with an elliptical aperture therethrough, the elliptical aperture having dimensions comprising a length and a width, a screw having a threaded rod, a post comprising first and second tubes, wherein the first tube is removably affixed to, and in vertical alignnment with, the second tube;

said first tube having an upper end and a lower end, said first tube having a solid cylinder at the lower end, said cylinder having a threaded hole recieving the threaded rod of the screw, and means to removably affix said post to the container roof, said means comprising a foot having dimensions as compared to the dimensions of the elliptical aperture of the top surface of the corner of the container, as follows:

a length less than the length of the elliptical aperture, but greater than the width of the elliptical aperture, and a width less than the length and the width of the elliptical aperture, wherein said foot has an aperture through the surface thereof recieving the threaded rod of the screw, and wherein said threaded rod passes through the aperture in said foot and into said threaded hole of said cylinder wherein the foot is positioned within the hollow corner of the top surface of said container roof.

2. The standard shipping container of claim 1, wherein the means to removably affix the post to the container roof further comprises:

a square washer, having an aperture therethrough, said washer being affixed to said foot, and recieving the screw through the aperture thereof; and further configured to fit and rotate within the hollow corner of the container roof, but to inhibit substantial rotation of the foot when said washer is positioned within the elliptical aperture of the top surface of said corner.

3. The standard shipping container of claim 1, wherein the means to removably affix said post to the container roof is constructed from stainless steel.

4. The standard shipping container of claim 1, wherein the second tube is hollow, having an end and an inner diameter, and further comprises a second cylinder, said second cylinder having an outer diameter smaller than the inner diameter of the second tube, wherein said second cylinder is affixed to, and in vertical alignment with, the interior of the second tube, with a portion of said cylinder extending beyond the end of the second tube.

5. The standard shipping container of claim 1, said system supporting an accessory, wherein said system further comprises an accessory support structure secured to the post.

6. A standard shipping container having a roof and a mast support system removably affixed to a roof of the container and configured to support an accessory, comprising:

a container roof having a hollow corner, said corner having a top surface with an elliptical aperture therethrough, the elliptical aperture having dimensions comprising a length and a width, a screw having a threaded rod, a post comprising first and second tubes, wherein the first tube is removably affixed to, and in vertical alignment with, the second tube; said first tube having an upper end and a lower end, said first tube, having a solid cylinder at the lower end, said cylinder having a threaded hole recieving the threaded rod of the screw, and an exterior surface and one or more ledges affixed radially to said exterior surface; means to removably affix said post to the container roof, said means comprising a foot having dimensions as compared to the dimensions of the elliptical aperture of the top surface of the corner of the container, as follows:

a length less than the length of the elliptical aperture, but greater than the width of the elliptical aperture, and a width less than the length and the width of the elliptical aperture, wherein said foot has an aperture through the surface thereof receiving the threaded rod of the screw, and wherein said threaded rod passes through the aperture in said foot and into said threaded hole of said cylinder; and an accessory support structure securing to secure to the post, wherein a ledge of the post is positioned and partially supports the accessory structure wherein the foot is positioned within the hollow corner of the surface of said container roof.

7. The standard shipping container of claim 6, wherein the accessory support structure comprises:

a box configured to receive the post, and two u-bolts configured to wrap around the post, with each u-bolt having two ends, wherein the box has apertures to receive said ends of the u-bolts, and a tube affixed to said box, configured to support the accessory.

* * * * *

UNITED STATES PATENT AND TRADEMARK OFFICE

CERTIFICATE OF CORRECTION

PATENT NO. : 7,506,775 B2
APPLICATION NO. : 11/164032
DATED : March 24, 2009
INVENTOR(S) : Hartzell et al.

It is certified that error appears in the above-identified patent and that said Letters Patent is hereby corrected as shown below:

In claim 1, col. 4, line 24, delete the misspelled word “alignnment” with the correct spelling of the word, namely --alignment--

In claim 1, col. 4, line 27, delete the misspelled word “recieving” and replace with the correct spelling of the word, namely --receiving--

In claim 1, col. 4, line 38, delete the word “recieving” and replace with the word --receiving--

In claim 2, col. 4, line 47, delete the word “recieving” and replace with the word --receiving--

In claim 6, col. 5, line 15, delete the word “recieving” and replace with the word --receiving--

In claim 6, col. 5, line 9, delete the phrase “to secure”

In claim 6, col. 5, line 12, delete the term “surface” and replace with the phrase --top surface--

Signed and Sealed this

Twenty-first Day of April, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,506,775 B2
APPLICATION NO. : 11/164032
DATED : March 24, 2009
INVENTOR(S) : Hartzell et al.

It is certified that error appears in the above-identified patent and that said Letters Patent is hereby corrected as shown below:

In claim 1, col. 4, line 24, delete the misspelled word “alignnment” with the correct spelling of the word, namely --alignment--

In claim 1, col. 4, line 27, delete the misspelled word “recieving” and replace with the correct spelling of the word, namely --receiving--

In claim 1, col. 4, line 38, delete the word “recieving” and replace with the word --receiving--

In claim 2, col. 4, line 47, delete the word “recieving” and replace with the word --receiving--

In claim 6, col. 5, line 15, delete the word “recieving” and replace with the word --receiving--

In claim 6, col. 6, line 9, delete the phrase “to secure”

In claim 6, col. 6, line 12, delete the term “surface” and replace with the phrase --top surface--

This certificate supersedes the Certificate of Correction issued April 21, 2009.

Signed and Sealed this

Twelfth Day of May, 2009

John Doll

JOHN DOLL
*Acting Director of the United States Patent and Trademark Office*